US008985572B2

(12) United States Patent
Ishida

(10) Patent No.: US 8,985,572 B2
(45) Date of Patent: Mar. 24, 2015

(54) SHEET LOADING UNIT, SHEET TRANSPORT DEVICE, AND IMAGE FORMING APPARATUS INCLUDING THE SAME

(71) Applicant: KYOCERA Document Solutions Inc., Osaka (JP)

(72) Inventor: Hirotaka Ishida, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/460,274

(22) Filed: Aug. 14, 2014

(65) Prior Publication Data

US 2015/0054218 A1 Feb. 26, 2015

(30) Foreign Application Priority Data

Aug. 22, 2013 (JP) ..... 2013-172092

(51) Int. Cl.
*B65H 5/36* (2006.01)
*B65H 1/04* (2006.01)
*B65H 9/10* (2006.01)

(52) U.S. Cl.
CPC .. *B65H 1/04* (2013.01); *B65H 5/36* (2013.01); *B65H 9/101* (2013.01); *B65H 2701/1131* (2013.01); *B65H 2511/12* (2013.01)
USPC ..... 271/171; 271/240

(58) Field of Classification Search
CPC ..... B65H 5/36; B65H 9/101; B65H 2511/12; B65H 2701/1131
USPC ..... 271/171, 240
See application file for complete search history.

(56) References Cited

U.S. PATENT DOCUMENTS

| | | | | |
|---|---|---|---|---|
| 8,678,381 | B2 * | 3/2014 | Kim et al. | 271/220 |
| 2003/0151188 | A1 * | 8/2003 | Imahara | 271/171 |
| 2007/0138737 | A1 * | 6/2007 | Yamada | 271/171 |
| 2007/0194517 | A1 * | 8/2007 | Nose et al. | 271/171 |
| 2011/0309570 | A1 * | 12/2011 | Uchino | 271/253 |
| 2013/0001866 | A1 * | 1/2013 | Hsu | 271/171 |
| 2013/0043649 | A1 * | 2/2013 | Hsu | 271/240 |
| 2013/0056925 | A1 * | 3/2013 | Hsu | 271/171 |
| 2013/0265600 | A1 * | 10/2013 | Fukuma | 358/1.12 |
| 2014/0291919 | A1 * | 10/2014 | Arimura | 271/171 |

FOREIGN PATENT DOCUMENTS

JP H 3-46429 U 4/1991

* cited by examiner

*Primary Examiner* — Patrick Cicchino
(74) *Attorney, Agent, or Firm* — Stein IP, LLC

(57) ABSTRACT

A sheet loading unit includes a main body, a sheet loading plate, a pair of positioning portions, a pair of racks, and a pinion. The sheet loading plate is disposed on an upper surface of the main body. The racks are connected to the positioning portions. The pinion engages with the pair of racks so that the positioning portions move in an interlocking manner. At least one of the racks includes a stopper capable of moving between a first position facing a lower surface of the pinion and a second position not facing the lower surface of the pinion when the rack moves along the width direction.

8 Claims, 6 Drawing Sheets

SHEET LOADING UNIT, SHEET TRANSPORT DEVICE, AND IMAGE FORMING APPARATUS INCLUDING THE SAME

CROSS-REFERENCE TO RELATED APPLICATIONS

This application is based upon and claims the benefit of priority from the corresponding Japanese Patent Application No. 2013-172092, filed Aug. 22, 2013, the entire contents of which are incorporated herein by reference.

BACKGROUND OF THE INVENTION

The present disclosure relates to a sheet loading unit including a pair of cursors for positioning sheets in a width direction, and a pinion engaging with racks of the cursors so as to rotate, and to a sheet transport device and an image forming apparatus including the same.

Conventionally, there is widely used a sheet loading unit equipped with a pair of cursors including racks moving in the width direction of a paper sheet (sheet) and positioning portions for positioning the paper sheet in the width direction, and a pinion engaging with the pair of racks so as to rotates when the racks move. The racks and the pinion are disposed between a sheet loading plate on which the paper sheets are loaded and a main body disposed below the sheet loading plate, and the positioning portions of the cursors are disposed above the sheet loading plate.

In an assembling process of this sheet loading unit, the sheet loading plate is placed in a turned over state (upside down), and the pair of racks are placed on the sheet loading plate. Then, the pinion is engaged with the pair of racks and is attached to a shaft of the sheet loading plate. After that, the sheet loading plate, the racks and the pinion are turned over and are placed and attached onto the main body. In order to prevent the pinion from dropping off in this case, a snap fit structure for preventing drop-off of the pinion is provided to the shaft of the sheet loading plate in the conventional sheet loading unit.

SUMMARY OF THE INVENTION

A sheet loading unit according to an aspect of the present disclosure includes a main body, a sheet loading plate, a pair of positioning portions, a pair of racks, and a pinion. The sheet loading plate is disposed on an upper surface of the main body, and at least a part of sheet is loaded on it. The positioning portions are disposed to be opposed to each other on an upper surface of the sheet loading plate and are capable of moving in a width direction perpendicular to a sheet transport direction, so as to contact with the sheet for performing positioning of the sheet in the width direction. The racks are connected to the positioning portions and include rack gear parts disposed between the sheet loading plate and the main body so as to extend in the width direction. The pinion is supported between the sheet loading plate and the main body in a rotatable manner and is engaged with the pair of rack gear parts so that the positioning portions move in an interlocking manner. At least one of the racks is provided with a stopper capable of moving between a first position facing a lower surface of the pinion and a second position not facing the lower surface of the pinion in response to the rack moves along the width direction.

Other objects of the present invention and specific advantages obtained from the present disclosure will become more apparent from the description of embodiments given below.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Now, embodiments of the present disclosure are described with reference to the drawings.

With reference to FIG. 1 to FIG. 10, a structure of an multifunction peripheral 100 equipped with a document loading unit (sheet loading unit) 30 according to an embodiment of the present disclosure is described. Note that a tandem color multifunction peripheral is described here as the image forming apparatus. Four image forming units Pa, Pb, Pc, and Pd are disposed in order from a transport direction upstream side (right side in FIG. 1) in a main body of the multifunction peripheral 100. These image forming units Pa to Pd are disposed corresponding to four images of different colors (magenta, cyan, yellow and black), and form magenta, cyan, yellow and black images in order by charging, exposing, developing, and transferring processes.

Figure 1:
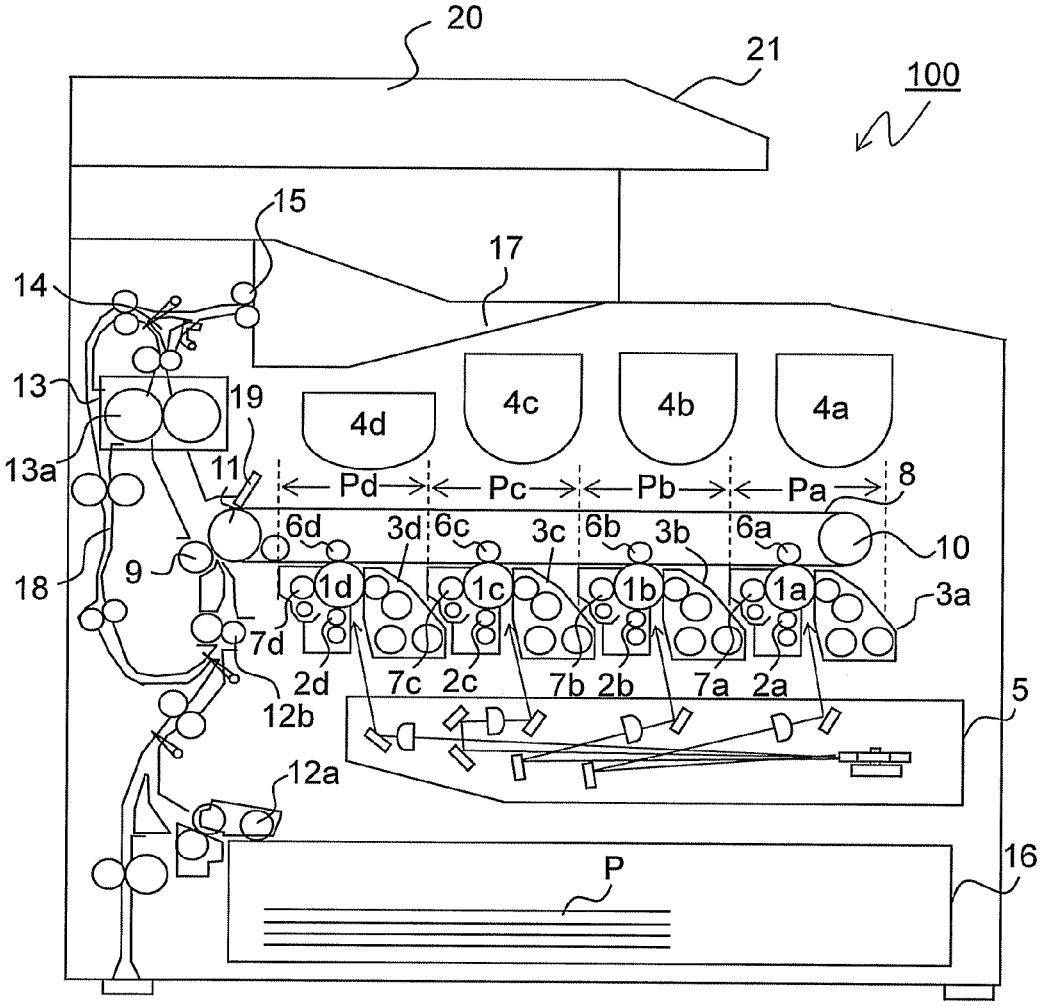
FIG. 1 is a cross-sectional view schematically illustrating a structure of a multifunction peripheral equipped with a document loading unit according to an embodiment of the present disclosure.

These image forming units Pa to Pd are provided with photoreceptor drums 1*a*, 1*b*, 1*c* and 1*d* for carrying visible images (toner images) of individual colors, respectively, and an intermediate transfer belt 8 driven by drive means (not shown) to rotate in a clockwise direction in FIG. 1 is disposed to be adjacent to the image forming units Pa to Pd. The toner images formed on the photoreceptor drums 1*a* to 1*d* are primarily transferred and superposed in order onto the intermediate transfer belt 8 that moves while contacting with the photoreceptor drums 1*a* to 1*d*. After that, the toner image on the intermediate transfer belt 8 is secondarily transferred onto a paper sheet P as an example of a recording medium by a secondary transfer roller 9 and is further fixed onto the paper sheet P by a fixing unit 13. Then, the paper sheet P is discharged from the apparatus main body. The photoreceptor drums 1*a* to 1*d* are rotated in a counter clockwise direction in FIG. 1 so that image forming processes are performed on the photoreceptor drums 1*a* to 1*d*.

The paper sheet P onto which the toner image is transferred is stored in a paper sheet cassette 16 in a lower part of the apparatus. The paper sheet P is transported by a sheet feed roller 12*a* and a registration roller pair 12*b* to a nip part between the secondary transfer roller 9 and a drive roller 11 for the intermediate transfer belt 8 described later. The intermediate transfer belt 8 is made of a dielectric resin sheet, and a seamless belt is mainly used. In addition, on a downstream side of the secondary transfer roller 9, there is disposed a blade-like belt cleaner 19 for removing the toner and the like remaining on the surface of the intermediate transfer belt 8.

An image reading unit 20 includes a scanning optical system equipped with a scanner lamp for illuminating a document (sheet) in copying and a mirror for changing an optical path of reflection light from the document, a condenser lens for condensing the reflection light from the document to form an image, and a CCD sensor for converting the formed image light into an electric signal (which are not shown). The image reading unit 20 reads a document image and generates image data.

Figure 2:
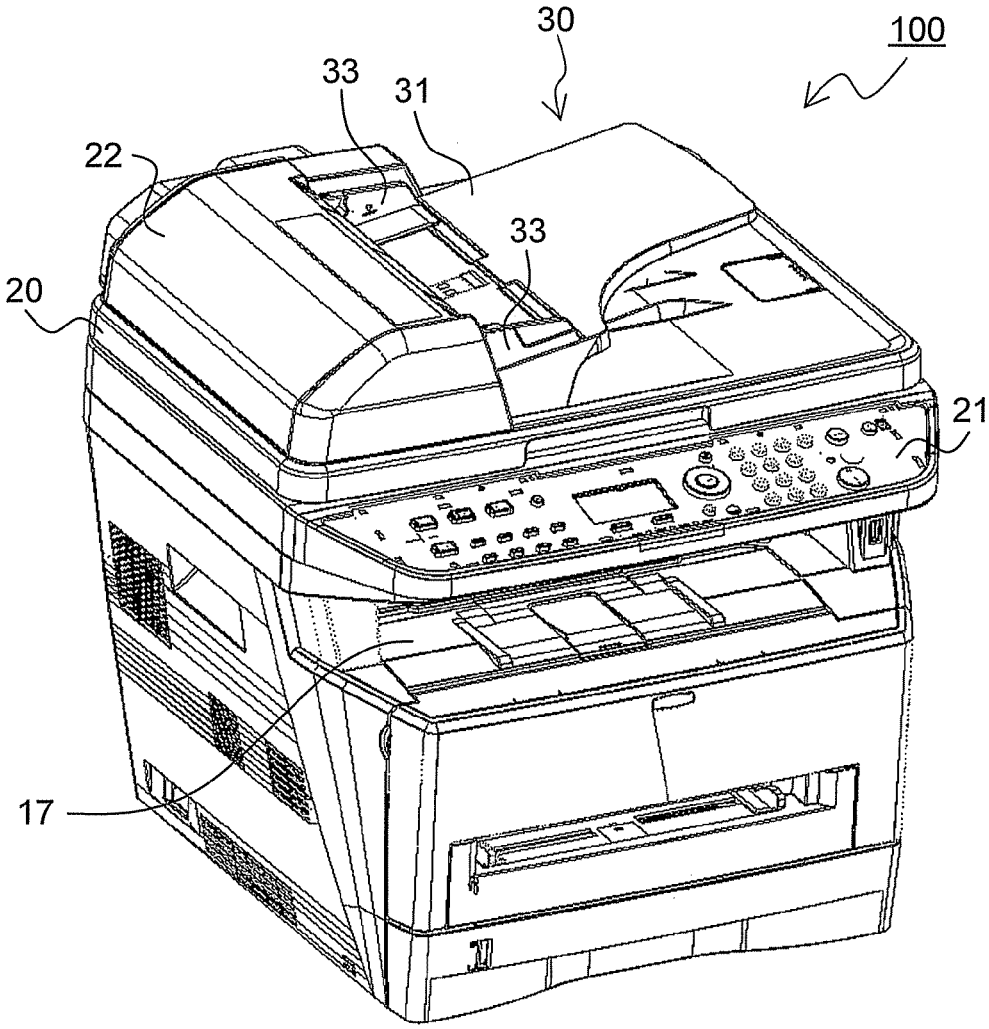
FIG. 2 is a perspective view illustrating a structure of a multifunction peripheral equipped with the document loading unit according to an embodiment of the present disclosure.

On an upper surface of the image reading unit 20, there are disposed a document placing table (not shown) equipped with a transparent glass plate (contact glass) and an operation panel 21 protruding toward a front of the apparatus. In addition, on the upper surface of the image reading unit 20, a document transport device (sheet transport device) 22 (see FIG. 2) including a transport roller (sheet transport unit) and the like for transporting the document sheet to an image reading position on the document placing table is supported in an openable and closable manner. Note that FIG. 2 is an external perspective view of the multifunction peripheral 100 viewed from the front (right direction in FIG. 1).

Next, the image forming units Pa to Pd are described. As illustrated in FIG. 1, around and below the photoreceptor drums 1*a* to 1*d* disposed in a rotatable manner, there are disposed chargers 2*a*, 2*b*, 2*c* and 2*d* for charging the photoreceptor drums 1*a* to 1*d*, an exposing device 5 for exposing image information on the photoreceptor drums 1*a* to 1*d*, developing units 3*a*, 3*b*, 3*c* and 3*d* for forming toner images on the photoreceptor drums 1*a* to 1*d*, and cleaning units 7*a*, 7*b*, 7*c* and 7*d* for removing developer (toner) and the like remaining on the photoreceptor drums 1*a* to 1*d*.

When image data is input from the image reading unit 20, first the surfaces of the photoreceptor drums 1*a* to 1*d* are uniformly charged by the chargers 2*a* to 2*d*. Then, the exposing device 5 irradiates the photoreceptor drums 1*a* to 1*d* with light in accordance with the image data, and hence electrostatic latent images corresponding to the image data are formed on the photoreceptor drums 1*a* to 1*d*. A predetermined amount of two-component developer containing magenta, cyan, yellow and black color toner are respectively filled in the developing devices 3*a* to 3*d*. Further, when a ratio of toner in the two-component developer stored in the developing devices 3*a* to 3*d* becomes lower than a predetermined value as toner images are formed as described below, the toner is supplied from toner cartridges 4*a* to 4*d* to the developing devices 3*a* to 3*d*. The toner in the developer is supplied by the developing devices 3*a* to 3*d* onto the photoreceptor drums 1*a* to 1*d* and is adhered to the same in an electrostatic manner so that the toner image is formed in accordance with the electrostatic latent image formed by exposure by the exposing device 5.

Then, a predetermined transfer voltage is applied to primary transfer rollers 6*a* to 6*d* so that the magenta, cyan, yellow and black toner images on the photoreceptor drums 1*a* to 1*d* are primary transferred onto the intermediate transfer belt 8. These four color images are formed with a predetermined positional relationship determined for forming a predetermined full color image in advance. After that, as preparation for successive formation of a new electrostatic latent image, the toner and the like remaining on the surface of the photoreceptor drums 1*a* to 1*d* is removed by the cleaning units 7*a* to 7*d*.

The intermediate transfer belt 8 is stretched around a transport roller 10 on an upstream side and the drive roller 11 on a downstream side. When a driving motor (not shown) rotates the drive roller 11, the intermediate transfer belt 8 starts to rotate in a clockwise direction. Then, the paper sheet P is transported from the registration roller pair 12*b* at predetermined timing to the nip part (secondary transfer nip part) between the drive roller 11 and the adjacent secondary transfer roller 9, and the full color image on the intermediate transfer belt 8 is transferred onto the paper sheet P. The paper sheet P with the transferred toner image is transported to the fixing unit 13.

The paper sheet P transported to the fixing unit 13 is heated and pressed by a fixing roller pair 13*a* so that the toner image is fixed to the surface of the paper sheet P, and a predetermined full color image is formed. A transport direction of the paper sheet P with the formed full color image is changed at a branching part 14 branching into a plurality of directions. When forming an image only on one side of the paper sheet P, the paper sheet P is discharged onto a discharge tray 17 as it is by a discharge roller 15.

On the other hand, when forming images on both sides of the paper sheet P, the paper sheet P after passing the fixing unit 13 is temporarily transported in the direction to the discharge roller 15. After a rear end of the paper sheet P passes the branching part 14, the discharge roller 15 is reversely rotated, and the transport direction of the branching part 14 is switched. Then, the rear end of the paper sheet P is led to a paper sheet transport path 18 so that the paper sheet P is transported again to the secondary transfer nip part in a state where the image side is reversed. Then, the next image formed on the intermediate transfer belt 8 is transferred by the secondary transfer roller 9 onto the new side without an image of the paper sheet P. Then, the paper sheet P is transported to the fixing unit 13 so that the toner image is fixed, and then is discharged onto the discharge tray 17.

Next, a structure of the document loading unit 30 disposed in the document transport device 22 of the image reading unit 20 is described.

Figure 3:
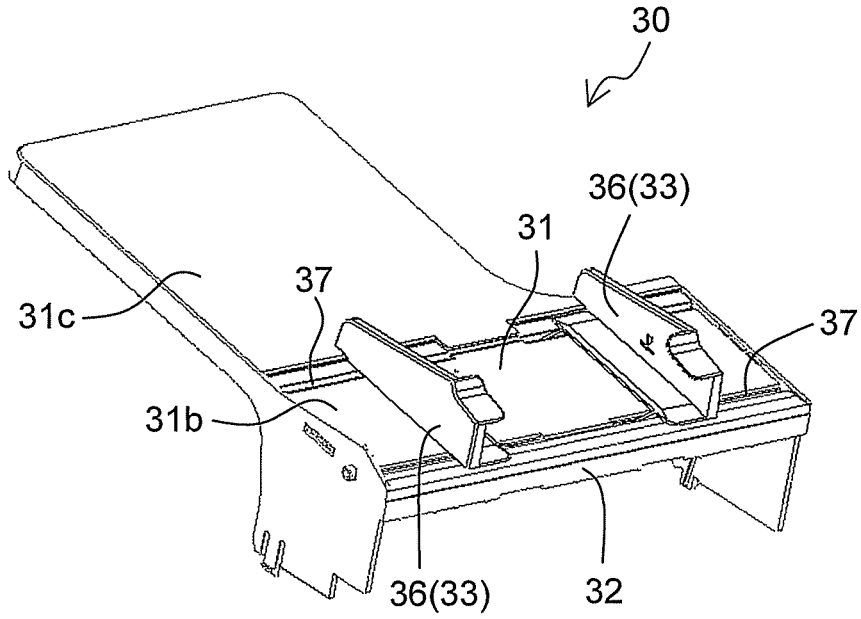
FIG. 3 is a perspective view illustrating a structure of the document loading unit according to an embodiment of the present disclosure.

As illustrated in FIG. 2 and FIG. 3, the document loading unit 30 includes a document loading plate (sheet loading plate) 31 on which the document (sheet) is loaded, a main body 32 disposed below the document loading plate 31 so as to support the document loading plate 31, a pair of cursors 33 for positioning the document, and a pinion 34 disposed between the document loading plate 31 and main body 32 in a rotatable manner (see FIG. 4).

As illustrated in FIG. 3, the document loading plate 31 is provided with two slits extending in a document width direction (perpendicular to a document transport direction), and the cursors 33 move along the slits. In addition, as illustrated in FIG. 4 and FIG. 5, a lower surface of the document loading plate 31 is provided with a shaft (boss) 31*a* protruding downward to be the rotation shaft of the pinion 34. Note that in the document loading plate 31, as illustrated in FIG. 3, a downstream side part 31*b* and an upstream side part 31*c* in the document transport direction may be formed separately or may be molded integrally.

Figure 6:
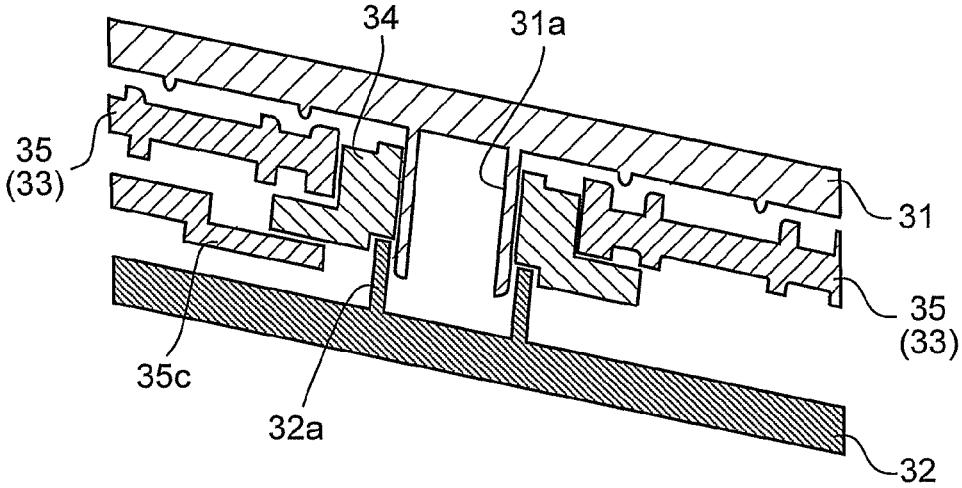
FIG. 6 is a cross-sectional view illustrating a structure of the rack and the pinion and vicinity thereof in the document loading unit according to an embodiment of the present disclosure.

The main body 32 forms a lower surface of the document loading unit 30. As illustrated in FIG. 6, the main body 32 is provided with a support 32*a* for supporting a lower surface of the pinion 34 so as to protrude upward at a position corresponding to the shaft 31*a* of the document loading plate 31. This support 32*a* has an inner diameter larger than an outer diameter of the shaft 31*a* and pivoted by the shaft 31*a*. In addition, an upper end (tip) of the support 32*a* is disposed upper than a lower end of the shaft 31*a* in the state where the document loading plate 31 is attached to the main body 32 and is disposed upper than a contact surface of a stopper 35*c* described later contacting with the pinion 34.

The cursors 33 include racks 35 disposed between the document loading plate 31 and the main body 32 so as to move along the document width direction (see FIG. 4) and positioning portions 36 connected to the racks 35 so as to be disposed to be opposed to each other on an upper surface of the document loading plate 31 for performing positioning in the document width direction (see FIG. 3). The rack 35 and the positioning portion 36 are attached to the main body 32 in a slidable manner so as to straddle two parallel slits 37 formed in the document loading plate 31 so as to extend in the document width direction. Note that the rack 35 and the positioning portion 36 may be integrally connected by fit-in or the like or may be formed integrally by resin molding.

Figure 4:
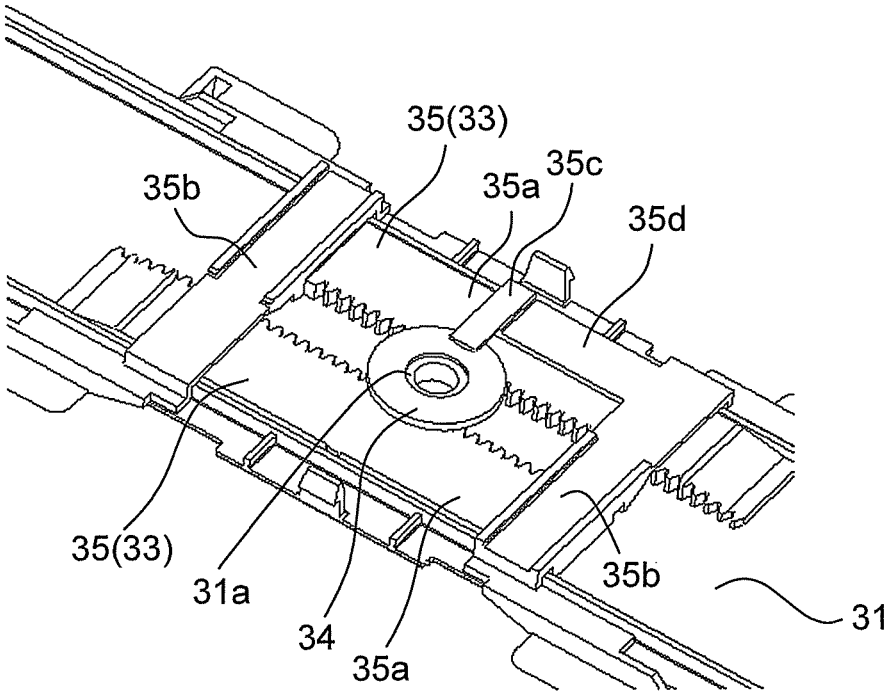
FIG. 4 is a perspective view illustrating a structure from below of a rack and a pinion and vicinity thereof in the document loading unit according to an embodiment of the present disclosure from which a main body is removed.
Figure 5:
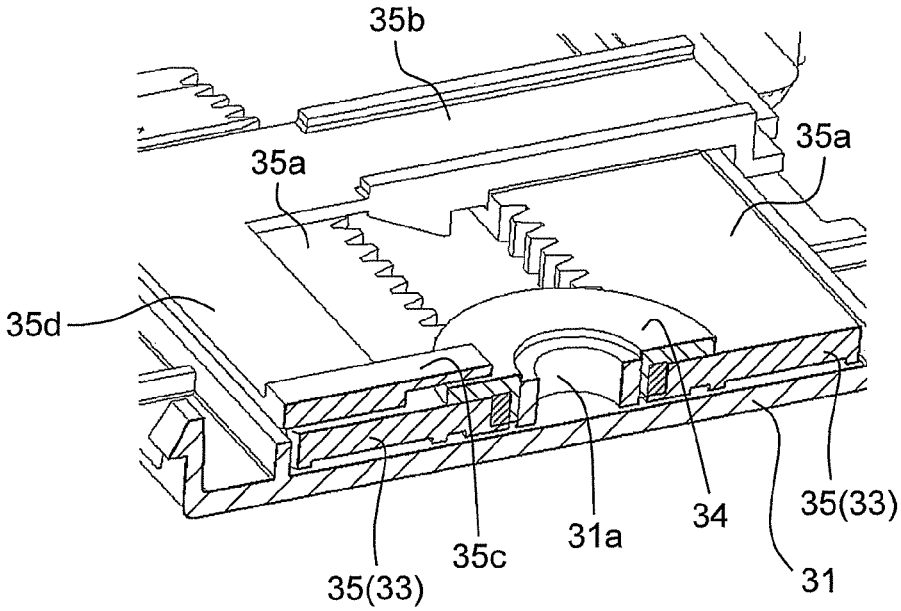
FIG. 5 is a cross section perspective view illustrating a structure from below of the rack and the pinion and vicinity thereof in the document loading unit according to an embodiment of the present disclosure from which the main body is removed.

As illustrated in FIG. 4, the rack 35 includes a sliding part (rack gear part) 35*a* extending in the document width direction and an extension part (connection part) 35*b* extending from one end of the sliding part 35*a* in a direction perpendicular to the document width direction. A rack gear extending in the document transport direction is formed on one side edge in a short side direction of the sliding part 35*a*. The extension part 35*b* of one of the racks 35 is formed to straddle the sliding part 35*a* of the other rack 35.

Here, the extension part 35*b* of the one of the racks 35 is provided with the stopper 35*c* that can pass a part of the lower surface of the pinion 34 (first position opposed to the lower surface of the pinion 34). Between this stopper 35*c* and the extension part 35*b*, there may be disposed a connection part (arm) 35*d* extending in the document width direction so as to connect the stopper 35*c* and the extension part 35*b* and to overlap the sliding part 35*a* of the other rack 35 in an up and down direction.

Figure 7:
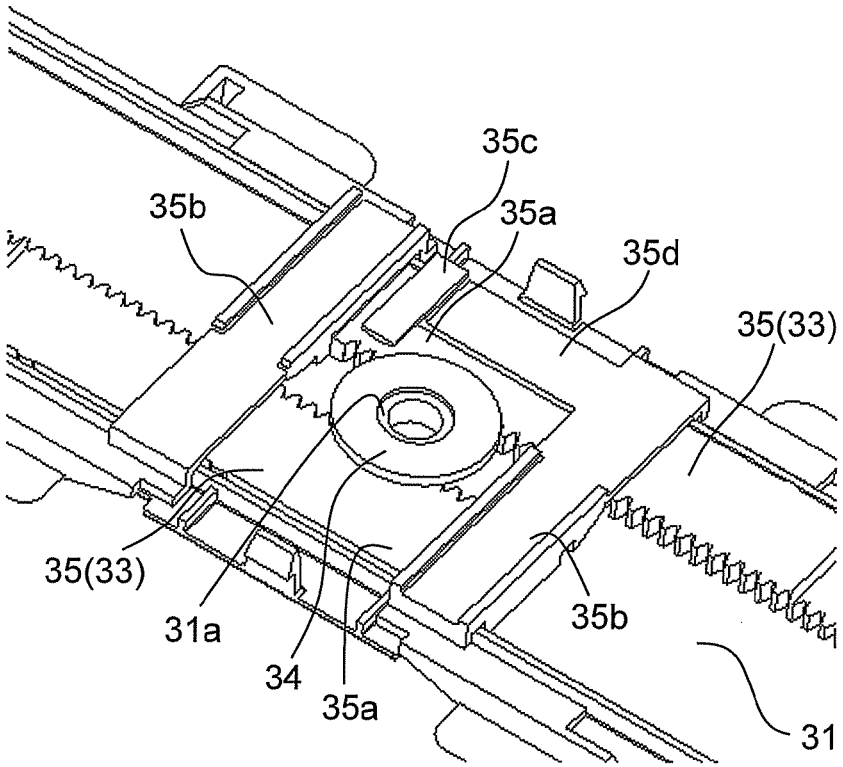
FIG. 7 is a perspective view illustrating a structure from below of the rack and the pinion and vicinity thereof in the document loading unit according to an embodiment of the present disclosure from which a main body is removed.

As illustrated in FIG. 4 and FIG. 7, the stopper 35*c* extends from the connection part 35*d* to the pinion 34. When the rack 35 moves along the document width direction, the stopper 35*c* moves between a first position facing (overlapping) the lower surface of the pinion 34 (position facing the upper surface in FIG. 4) and a second position that does not face (not overlap) the lower surface of the pinion 34. Then, in a state where the stopper 35*c* of one of the racks 35 is at the first position facing the lower surface of the pinion 34 (state of FIG. 4 and FIG. 5), the stopper 35*c* of one of the racks 35 and the sliding part 35*a* of the other rack 35 are opposed to each other via a part of the pinion 34.

Figure 8:
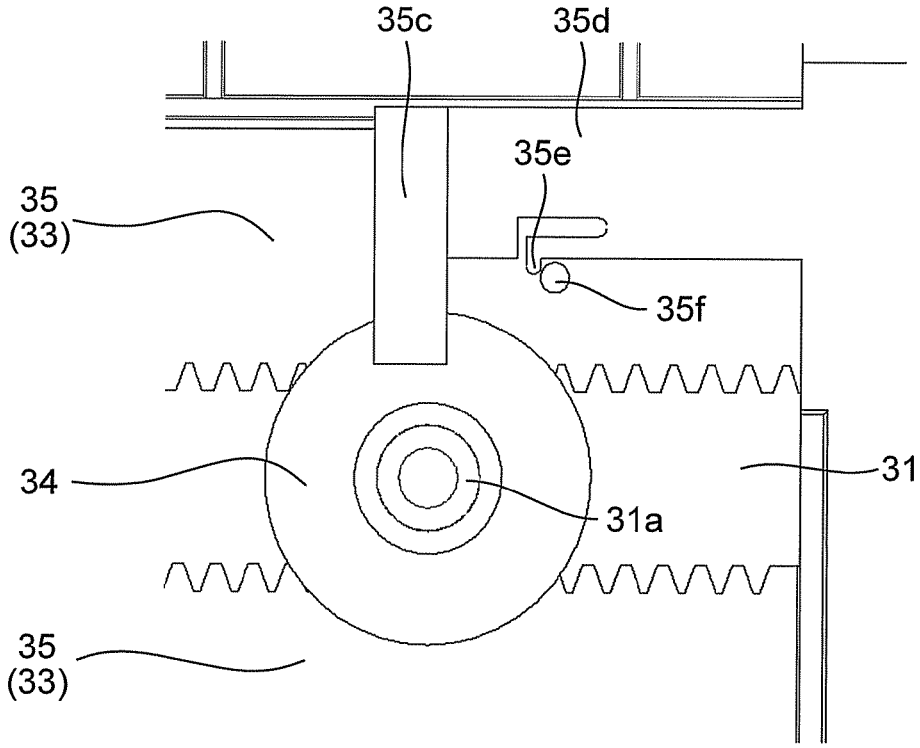
FIG. 8 is a bottom view illustrating a structure of the rack and the pinion and vicinity thereof in the document loading unit according to an embodiment of the present disclosure from which a main body is removed.

In addition, as illustrated in FIG. 8, the one of the racks 35 with the stopper 35*c* may be provided with a rib (contact rib) 35*e* that can be elastically deformed may be formed at one side edge of the connection part 35*d*, while the other rack 35 may be provide with an engaging part (protrusion) 35*f* that engages with the rib 35*e* when the stopper 35*c* moves to the first position facing the lower surface of the pinion 34. The engaging part 35*f* is protruding on a surface of the other rack 35.

Figure 9:
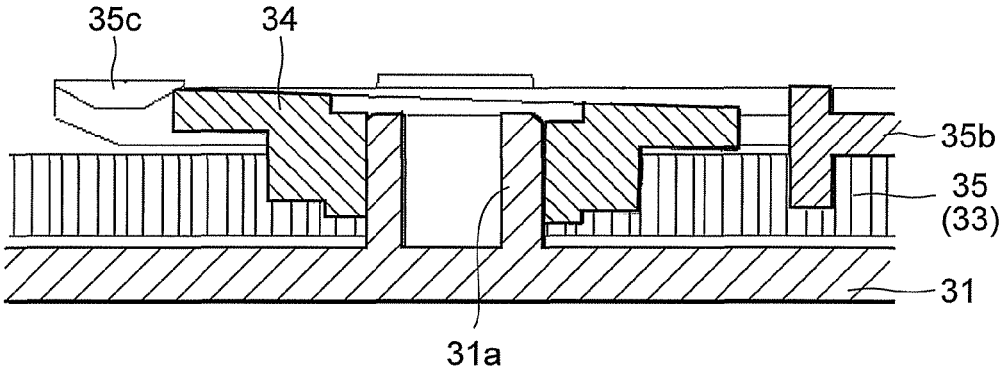
FIG. 9 is a cross-sectional view illustrating a state where the pinion goes up in the document loading unit according to an embodiment of the present disclosure.

In addition, as illustrated in FIG. 9, the surface of the stopper 35*c* facing the pinion 34 (lower surface of the stopper 35*c* in FIG. 9) at the first position is formed in a convex shape having inclined surfaces inclining to be lower toward both ends from a vertex that is the center in the document width direction (moving direction of the stopper 35*c*, or the left and right direction in FIG. 9).

As illustrated in FIG. 4 and FIG. 5, the pinion 34 is attached to the shaft 31*a* of the document loading plate 31 in a rotatable manner. The pinion 34 is provided with a pinion gear (not shown) engaging with the pair of rack gears, and the pinion 34 rotates along with movement of the racks 35. Therefore, when one of the cursors 33 is moved, the pinion 34 rotates so that the other cursor 33 moves in the opposite direction to the one of the cursors 33 by the same movement amount.

In a state where the document loading unit 30 is assembled (as illustrated in FIG. 6), the pinion 34 is supported by the support 32*a* of the main body 32 so that a predetermined gap is formed between the pinion 34 and the stopper 35*c* so as not to contact with the stopper 35*c*.

Next, the assembling process of the document loading unit 30 is described.

First, as illustrated in FIG. 7, the document loading plate 31 is placed upside down, and the pair of racks 35 is placed thereon. Further, the rack 35 and the positioning portion 36 are secured via the slits of the document loading plate 31. In this case, the racks 35 are placed so that the positioning portions 36 are closest to each other.

After that, the pinion 34 is attached to the shaft 31*a* of the document loading plate 31 while the pinion gear of the pinion 34 is engaged with the pair of rack gears. In this case, the stopper 35*c* is placed at a position not contacting with the pinion 34.

After that, as illustrated in FIG. 4, the rack 35 is moved by a predetermined distance in the direction such that the positioning portions 36 approach to each other. Thus, the stopper 35*c* is moved to the first position facing the lower surface of the pinion 34 (at this stage, it is the position facing the upper surface of the pinion 34 because they are upside down). In this way, the pinion 34 is disposed between the stopper 35*c* and the sliding part 35*a* so that movement of the pinion 34 in the up and down direction is restricted.

Further, as illustrated in FIG. 8, when the stopper 35*c* is moved in the document width direction, it is perceived that the stopper 35*c* is moved to the first position facing the lower surface of the pinion 34 from a feeling when the rib 35*e* is engaged with the engaging part 35*f*. Therefore, it is not necessary to visually check a position of the stopper 35*c*. In addition, it is possible to prevent the cursors 33 from expanding during assembly work so that the stopper 35*c* is removed from the lower surface of the pinion 34 (the stopper 35*c* moves to the second position). In addition, as illustrated in FIG. 9, even if the pinion 34 is raised, the surface of the stopper 35*c* facing the pinion 34 (lower surface in FIG. 9) presses the pinion 34 so that the rise of the pinion 34 is corrected.

Figure 10:
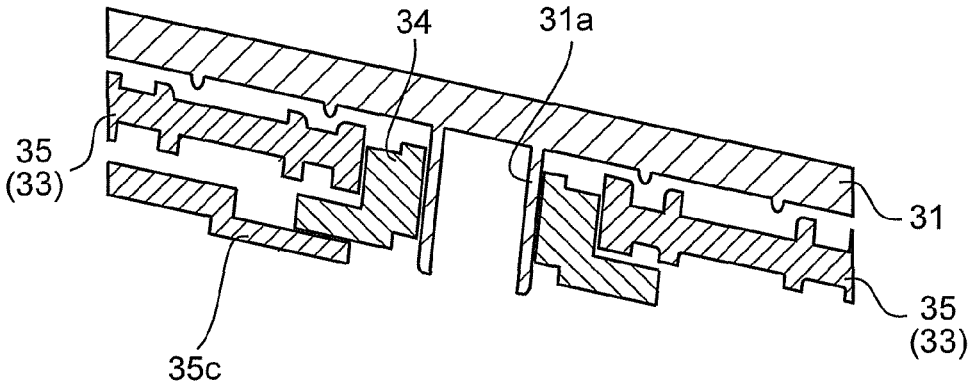
FIG. 10 is a cross-sectional view illustrating a state where a document loading plate and the rack and the pinion are turned upside down in an assembling process of the document loading unit according to an embodiment of the present disclosure.

Further, as illustrated in FIG. 10, the document loading plate 31, the rack 35, and the pinion 34 are turned upside down. In this case, because the stopper 35*c* supports the lower surface of the pinion 34, the pinion 34 does not drop off.

After that, as illustrated in FIG. 6, the document loading plate 31, the rack 35, and the pinion 34 are placed and attached onto the main body 32. In this case, the pinion 34 is raised and supported by the support 32*a* of the main body 32, and a predetermined gap is formed between the pinion 34 and the stopper 35*c*. In other words, the stopper 35*c* does not contact with the pinion 34.

In this way, the document loading unit 30 is assembled.

In this embodiment, as described above, one of the racks 35 is provided with the stopper 35*c* that can move between the first position facing (overlapping) the lower surface of the pinion 34 and the second position that does not face (not overlap) the lower surface of the pinion 34 in response to the rack 35 moves in the width direction. In this way, in the assembling process of the document loading unit 30, the document loading plate 31 is placed upside down, and the rack 35 and pinion 34 are placed thereon. Then, the stopper 35*c* is moved to the first position facing the lower surface of the pinion 34 (in this stage, it is the position facing the upper surface of the pinion 34 because the document loading plate 31, the rack 35, and the pinion 34 are placed upside down). Therefore, even if the document loading plate 31, the rack 35, and the pinion 34 are reversed upside down, the pinion 34 can be prevented from dropping off. Therefore, it is not necessary to provide the sheet loading plate with a snap fit structure for preventing drop-off of the pinion like the conventional sheet loading unit. Thus, it is not necessary to add a slide structure to a mold of the sheet loading plate or to form an opening in the surface of the sheet loading plate. Further, because it is not necessary to add the slide structure to the mold of the document loading plate 31, an increase of manufacturing cost can be suppressed. In addition, because it is not necessary to form the opening in the surface of the document loading plate 31, it is not necessary to attach a label or the like to the opening, and hence an increase of manufacturing cost and complicated manufacturing steps can be suppressed.

In addition, the drop-off of the pinion 34 can be prevented only by moving the stopper 35*c* to the first position facing the lower surface of the pinion 34 before turning upside down of the document loading plate 31, the rack 35, and the pinion 34. Therefore, the assembly work is not complicated.

In addition, as described above, the stopper 35*c* and the other rack 35 are opposed to each other via a part of the pinion 34 in a state where the stopper 35*c* of one of the racks 35 is disposed at the first position. In this way, drop-off of the pinion 34 can be easily prevented.

In addition, as described above, one of the racks 35 is provided with the rib 35*e* that can be elastically deformed, and the other rack 35 is provided with the engaging part 35*f* that engages with the rib 35*e* at the first position when the stopper 35*c* is being moved from the second position to the first position. In this way, in the assembling process of the document loading unit 30, when the stopper 35*c* is moved from the second position to the first position, it is perceived whether or not the stopper 35*c* is moved to the first position by a feeling when the engaging part 35*f* is engaged with the rib 35*e*. In other words, it is not necessary to visually check a position of the stopper 35*c*. Therefore, assembly workability can be improved.

In addition, as described above, the surface of the stopper 35*c* facing the pinion 34 is formed in a convex shape having inclined surfaces inclining to be lower toward both ends from a vertex that is the center in the document width direction (moving direction of the stopper 35*c*). In this way, when the pinion 34 is placed on the document loading plate 31, even if the worker misses rise (insufficient insertion) of the pinion 34, the surface of the stopper 35*c* facing the pinion 34 presses the pinion 34 so as to correct the rise when the stopper 35*c* is moved to the first position.

In addition, as described above, the pinion 34 is supported by the support 32*a* so that downward movement thereof is restricted in a state where the document loading unit 30 is assembled. Therefore, the pinion 34 does not contact with the stopper 35*c*. In this way, because deterioration of rotation performance of the pinion 34 can be suppressed, deterioration of operability of the cursors 33 can be suppressed.

Note that the embodiments described above are examples in every aspect and should not be interpreted as restrictions. The scope of the present disclosure is defined not by the above description of the embodiments but by the claims, which includes all modifications within equivalent meanings and range to the claims.

For instance, in the embodiment described above, the document loading unit 30 provided to the document transport device 22 of the image reading unit 20 is exemplified and described as the sheet loading unit of the present disclosure, but the present disclosure is not limited to this. For instance, the present disclosure can be applied also to a manual feeding tray (sheet loading unit). In addition, the present disclosure can be applied also to a sheet feed cassette (sheet loading unit) that can be attached to and detached from the image forming apparatus main body, in which the sheet stack tray (sheet loading plate) swings in the up and down direction.

In addition, in the embodiment described above, there is described an example where the stopper is provided to only one of the racks, but the present disclosure is not limited to this. It is possible to provide the stoppers to both racks.

What is claimed is:

1. A sheet loading unit comprising:

a main body;

a sheet loading plate disposed on an upper surface of the main body so that at least a part of a sheet is loaded on the sheet loading plate;

a pair of positioning portions disposed to be opposed to each other on an upper surface of the sheet loading plate, the positioning portions being able to move in a width direction perpendicular to a sheet transport direction, and contacting with the sheet so as to perform positioning of the sheet in the width direction;

a pair of racks connected to the positioning portions, including rack gear parts disposed between the sheet loading plate and the main body so as to extend in the width direction; and a pinion supported in a rotatable manner between the sheet loading plate and the main body so as to engage with the pair of rack gear parts so that the positioning portions move in an interlocking manner, wherein at least one of the racks is provided with a stopper capable to move between a first position facing a lower surface of the pinion and a second position not facing the lower surface of the pinion in response to the rack moves along the width direction.

2. The sheet loading unit according to claim 1, wherein when the stopper is placed at the first position, the stopper is opposed to a part of the other rack via a part of the pinion.

3. The sheet loading unit according to claim 1, wherein the sheet loading plate is provided with two parallel slits extending in the width direction, the rack includes a connection part attached to straddle the slits so as to be able to slide along the slits in the width direction, at least one of the connection parts of the pair of racks is provided with an arm overlapping the rack gear part of the other rack in an up and down direction so as to extend in the width direction, provided with the stopper, the other rack gear part is provided with a protrusion protruding on a surface of the other rack, one side edge of the arm is provided with a contact rib protruding in an elastically deformed manner so as to be able to contact with the protrusion, and when the stopper is being moved from the second position to the first position, the contact rib and the protrusion contact with each other at the first position.

4. The sheet loading unit according to claim 3, wherein the stopper extends from the arm toward the pinion; and a surface of the stopper facing a surface of the pinion at the first position is provided with inclined surfaces inclining to be lower toward both ends from a vertex that is a center in the width direction.

5. The sheet loading unit according to claim 1, further includes a boss protruding from a lower surface of the sheet loading plate so as to support the pinion in a rotatable manner, and a support protruding from an upper surface of the main body to support the lower surface of the pinion, wherein in a state where the sheet loading unit is assembled, a tip of the support is positioned upper than a contact surface of the stopper contacting with the pinion, and the pinion is supported by the support so that downward movement thereof is restricted and does not contact with the stopper.

6. The sheet loading unit according to claim 1, wherein in a state where the positioning portions are separated by a predetermined distance from a position closest to each other, the stopper is positioned at the first position.

7. A sheet transport device comprising the sheet loading unit according to claim 1 and a sheet transport unit.

8. An image forming apparatus comprising the sheet transport device according to claim 7 and an image forming unit.

* * * * *